US005730246A

United States Patent [19]

Beard

[11] Patent Number: 5,730,246

[45] Date of Patent: Mar. 24, 1998

[54] ROOF INSPECTION FALL PROTECTION SYSTEM

[75] Inventor: David W. Beard, Bloomington, Ill.

[73] Assignee: State Farm Mutual Automobile Insurance Co., Bloomington, Ill.

[21] Appl. No.: 502,030

[22] Filed: Jul. 13, 1995

[51] Int. Cl.[6] ..... E04G 1/36

[52] U.S. Cl. ..... 182/45; 182/3

[58] Field of Search ..... 182/45, 3, 115, 182/142

[56] References Cited

U.S. PATENT DOCUMENTS

| | | | |
|---|---|---|---|
| 3,237,717 | 3/1966 | Jackson | 182/45 |
| 4,078,633 | 3/1978 | Fahy | 182/45 |
| 4,122,916 | 10/1978 | Strobel | 182/45 |
| 4,232,759 | 11/1980 | Jacobs | 182/39 |
| 4,450,935 | 5/1984 | Gustavus | 182/45 |
| 4,560,074 | 12/1985 | Manning | 212/152 |
| 4,689,927 | 9/1987 | Green et al. | 52/180 |
| 4,695,023 | 9/1987 | McCafferty | 248/45 |
| 5,036,949 | 8/1991 | Crocker et al. | 182/3 |
| 5,148,890 | 9/1992 | Sipe | 182/45 |
| 5,249,397 | 10/1993 | Monaco | 52/126.1 |
| 5,249,769 | 10/1993 | Griek et al. | 248/225.1 |
| 5,282,597 | 2/1994 | Babcock | 248/237 |
| 5,287,944 | 2/1994 | Woodyard | 182/3 |
| 5,341,898 | 8/1994 | Baziuk | 182/142 |
| 5,343,979 | 9/1994 | Goto | 182/37 |
| 5,361,558 | 11/1994 | Thornton et al. | 52/698 |

*Primary Examiner*—Leslie A. Braun
*Assistant Examiner*—Anita M. King
*Attorney, Agent, or Firm*—Lowe, Price, LeBlanc & Becker

[57] ABSTRACT

A fall protection system is provided for protection of a worker on a building roof. The system includes a mast assembly resting on the ground and contacting a soffit of the roof. A cable support structure is secured to the mast assembly. A cable is connected at a first end to the cable support structure and includes a first portion extending upwardly from the cable support structure toward a peak of the roof and a second portion extending downwardly from the peak toward the ground and terminating at a second end. The second portion is adapted to connect to a harness secured to the worker. A weight hangs from the second end of the cable to hold the cable taut.

29 Claims, 5 Drawing Sheets

ROOF INSPECTION FALL PROTECTION SYSTEM

TECHNICAL FIELD

This invention relates to a fall restraint system or apparatus, and, more specifically, to a system for preventing falls from a roof of a building.

BACKGROUND ART

Fall prevention equipment is used to enhance safety and convenience of climbing a sloped roof, whether for construction workers when installing roofs or for inspectors climbing a roof to inspect for damages. The dangers of falls from such structures have been recognized, and a number of federal, state and local regulations require a safety system to be used when working on a roof.

Various conventional fall prevention equipments are available. Some examples are nailing support plates into the roof, erecting overhead cables, lines and/or support pieces, or attaching scaffolds and railings. These techniques are generally used when installing a roof or roof materials, and hence this equipment is not intended to be used for inspections of finished roofs.

Moreover, such equipment is unsuitable for inspections. Because the equipment is intended for use when installing a roof, the equipment oftentimes damages the roof or building wall structure. Additionally, the equipment is typically heavy and expensive. Also, erecting such equipment often requires considerable time. Furthermore, the conventional equipment is additionally unsuitable for a finished roof as it has been known to destroy the water-tight integrity of the roof.

No prior art devices are known that can restrain a roof climber without attaching to the structure with nails or other fasteners that require customization or conditioning of a standard rooftop while simultaneously biasing or supporting a ladder against the roof. For example, U.S. Pat. No. 5,282,597 to Babcock relates to a safety line anchoring device with layered fastening straps nailed through the lower shingle, thus leaving the top shingle unpunctured. U.S. Pat. No. 5,287,944 to Woodyard relates to a roof mounted anchor used in a fall restraint system. The anchor uses wooden screw fasteners to mount the anchor to the roof top. Similarly, U.S. Pat. No. 5,361,558 to Thornton et. al. relates to a safety line anchor mounted on roof. The legs of the anchor are secured to the roof by lag screws. Accordingly, all of the above prior art methods require screws to be inserted in the roof top to secure the anchoring device thereto, raising or causing significant problems discussed above.

U.S. Pat. No. 4,450,935 to Gustavus and U.S. Pat. No. 4,695,023 to McCafferty both relate to platforms for use on a roof ladder. No mechanism is utilized for use in connection with a fall restraint system. Further, neither of these patents relate to affixing or biasing regular ladders to the roof top while also providing a fall restraint system.

U.S. Pat. No. 5,036,949 to Crocker et. al. relates to a motion-stopping system for roof workers. The system uses bolts to threadedly engage in holes to grip the structural members by tightening the bolts. The system requires preconditioned areas of the roof for attachment with the gripping anchor.

It has been discovered that it is desirable to provide a fall protection system for use in climbing sloped, finished roofs and the like, without requiring conditioning of the roof top. It has also been discovered that such a fall protection system is needed that does not require affixation to the roof using screws, bolts and the like that may cause damage thereto.

It has further been discovered that a fall restraint system is needed that prevents or restrains a roof top climber from falling while simultaneously biases or affixes a regular ladder to the structure so that the climber can descend from the roof top safely.

It has additionally been discovered that a natural place on a structure to support a roof top climber and to restrain the climber is the roof eave or portion of the roof that extends over the structure.

DISCLOSURE OF THE INVENTION

Thus, a principal object of the invention is to provide a device for use in climbing sloped roofs to effectively restrain the climber from sliding.

Another object of the present invention is to provide such a device which is simple, safe and inexpensive in construction.

A further object of the invention is to provide a device that is lightweight, portable, that can be assembled and disassembled quickly and easily and that can be transported in a compact form, such as in the trunk of an automobile.

Yet another object of the invention is to provide a fall protection device that does not require physical attachment by, for instance, nails or other fasteners to the building structure.

According to the present invention, a fall protection apparatus is provided for protection of a worker on a building roof. The apparatus includes a mast assembly adapted to rest on a ground surface and contacting a soffit of the roof. A cable support structure is secured to the mast assembly. A cable is connected at a first end to the cable support structure and includes a first portion extending upwardly from the cable support structure toward a peak of the roof and a second portion extending downwardly from the peak toward the ground and terminating at a second end. The second portion is adapted to connect to a harness secured to the worker. A weight hangs from the second end of the cable to hold the cable taut. Preferably, the weight is approximately 5 kg.

According to a preferred embodiment, the mast assembly includes a support foot, a generally vertical mast, and a soffit load bearing member contacting the soffit.

It is preferred that the mast be pivotable relative to the load bearing member.

According to another preferred embodiment, the mast assembly further includes a horizontal truss on which the load bearing member is disposed, with the mast being pivotal relative to the horizontal truss.

Preferably, the mast assembly includes a stop for limiting the pivotal movement of the mast relative to the horizontal truss. The stop preferably limits the pivotal movement of the mast relative to the horizontal truss to about ±10° from horizontal.

In a preferred embodiment, the mast assembly includes a bracket attached to the horizontal truss and to which the mast is secured. The stop includes a pair of posts protruding from the bracket and longitudinally disposed on opposite sides of the mast such that upon pivotal movement of the horizontal truss, one of the pair of posts contacts the mast.

According to another aspect of the invention, the mass support assembly includes a stabilizer disposed on the horizontal truss. The stabilizer preferably contacts the soffit of the roof and stabilizes the apparatus in an unloaded condition.

It is preferred that the mast be made of fiberglass.

According to another preferred embodiment, the cable support structure is disposed at an eave of the roof and extends upwardly from the eave.

According to a further preferred embodiment, the cable support structure includes a roof load bearing member contacting the roof and a cable attachment point.

It is also preferred that the cable support structure include a vertical support and a generally triangular brace pivotally secured to the vertical support at a pivot point. A first leg of the triangular brace extends from the pivot point to the roof load bearing member. A second leg of the triangular brace extends from the pivot point to the cable attachment point. A third leg of the triangular brace extends from the cable attachment point to the roof load bearing member.

Preferably, the first leg comprises a pair of struts, each extending from the pivot point to an end of the roof load bearing member.

According to another aspect of the invention, the cable support structure further includes means for adjusting the height of the vertical support.

Preferably, the vertical support includes an outer tubular member, an inner nested tubular member and a quick release pin. The inner member includes a series of vertically disposed holes. The outer member includes a hole disposed at an upper end thereof. The quick release pin is received within the outer member hole and one of the series of vertically disposed holes on the inner member. It is preferred that a ladder provides access to the second portion of the cable from the ground.

According to another embodiment of the present invention, a fall protection apparatus for protection of a harnessed worker on a building roof includes a mast resting on the ground and contacting a soffit of the roof. A structure is provided. A soffit load bearing member contacts the soffit and is supported by the structure. A roof load bearing member contacts the roof and is supported by the structure. A cable extends from the structure over a peak of the roof and downwardly toward an opposing roof soffit to a free end. The cable is adapted to connect to the worker's harness. A weight hangs from the free end of the cable.

In a preferred embodiment, a stabilizer is supported by the structure. The stabilizer preferably contacts the soffit.

Preferably, the mast assembly includes a height adjustment mechanism for adjusting the height of the mast.

According to one aspect of the invention, the structure comprises a horizontal truss on which the soffit load bearing member is disposed, a height-adjustable vertical support, and a generally triangular brace pivotally secured to the vertical support at a pivot point. The roof load bearing member is disposed on a first leg of the triangular base. The cable is connected to the triangular brace at a cable attachment point.

Preferably, the first leg extends from the pivot point to the roof load bearing member. The triangular brace further preferably includes a second leg extending from the pivot point to the cable attachment point, and a third leg extending from the cable attachment point to the roof load bearing member.

The above and other objects, feature advantages of the present invention, will become apparent from the following description and the claims taken in conjunction with the accompanying drawings.

BEST MODE FOR CARRYING OUT THE INVENTION

Figure 1:
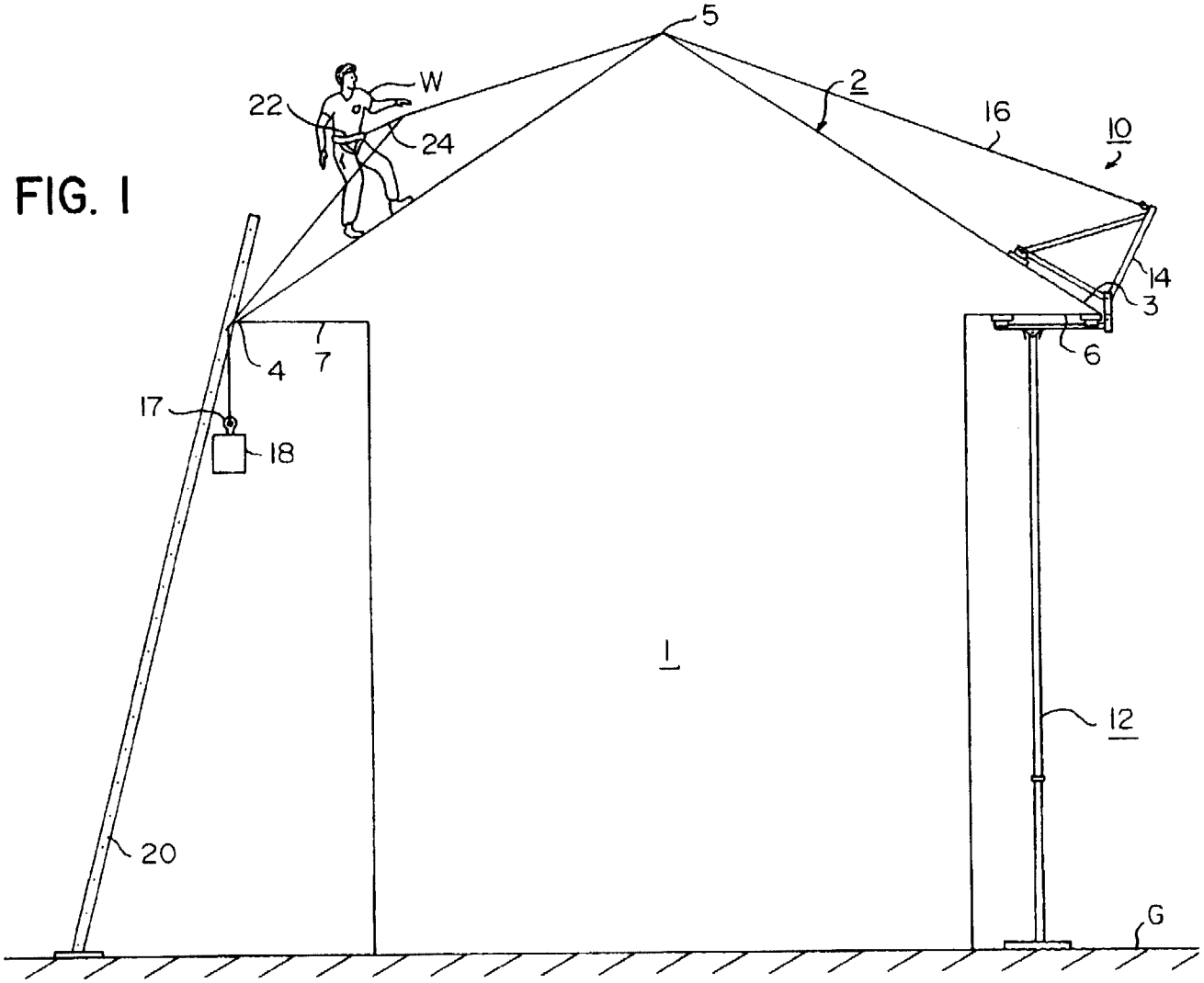
FIG. 1 is a sectional view, with the building represented schematically, of the roof inspection fall protection apparatus according to the present invention.

Referring to FIG. 1 of the drawings, a roof inspection fall protection apparatus 10 is shown as installed on a building 1 including a roof 2. In the embodiment of FIG. 1, roof 2 includes a pair of opposing eaves 3, 4, a peak 5, and a pair of opposing soffits 6, 7. It will be appreciated by one skilled in the art that the invention as described herein may be adapted for use on other types of roofs.

Fall protection apparatus 10 generally includes a mast assembly 12, a cable support structure 14, a cable 16, a weight 18 suspended from cable 16 and a ladder 20. As depicted in FIG. 1, mast assembly 12 is generally disposed between the ground G and soffit 6. Cable support 14 is attached to mast assembly 12 and is positioned on the upper surface of the roof, near eave 3. Cable 16 is suspended between cable support structure 14 and extends upwardly over the peak 5 of roof 2 and downwardly toward the other side of the roof, contacting and extending below eave 4 and terminating at an end 17. Weight 18 is attached to cable 16 at end 17. Weight 18 is preferably approximately 5 kg.

A worker W is shown wearing a harness 22. Harness 22 is removably attached to cable 16 via a conventional rope adjuster 24. Rope adjuster 24 couples the harness to the cable. Typically, worker W dons on the harness 22 on the ground, before climbing ladder 20. After climbing ladder 20 and reaching eave 4 in the vicinity of cable 16, worker W attaches harness 22 to cable 16 at rope adjuster 24. Worker W is then protected by fall protection apparatus 10 while inspecting roof 2.

Figure 2:
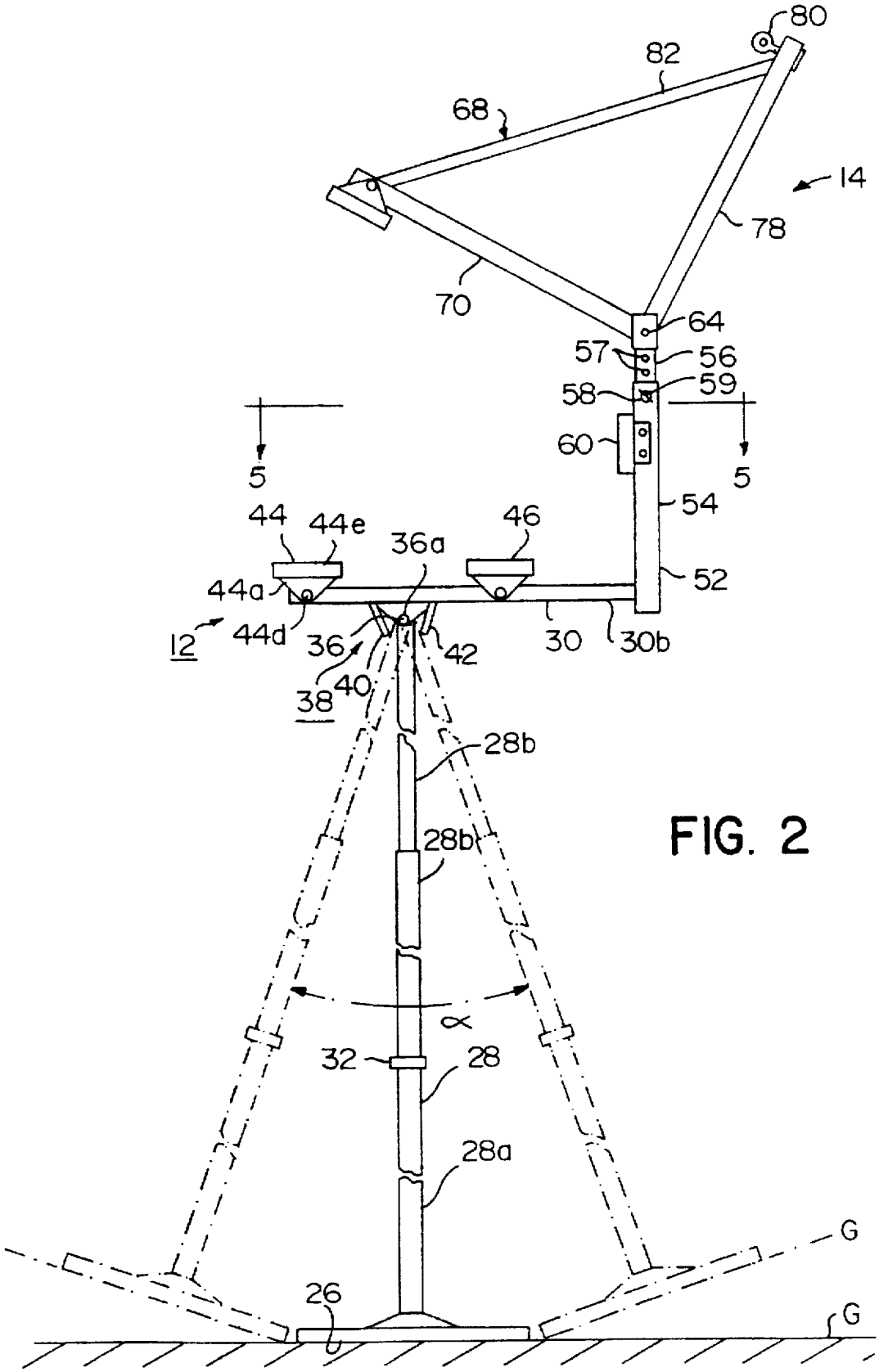
FIG. 2 is a detailed elevation view of the apparatus of FIG. 1, with the cable and building omitted for clarity.

Referring to FIG. 2, mast assembly 12 includes a support foot 26 contacting ground G. A vertical mast 28 is supported at one end by support foot 26. At the other end, a generally vertical mast 28 is pivotally connected to a horizontal truss 30 to permit vertical mast 28 to be stabilized on a sloped ground surface. Additionally, vertical mast 28 is preferably adjustable in height to permit use of one apparatus on buildings of varying heights. For instance, vertical mast 28 may include an outer tubular member **28*a*. One or more inner tubular members 28*b* may be telescopically received within outer tubular member 28*a* such that inner tubular members 28*b* may be extended or contracted within outer tubular 28*a* to provide varying heights. A height adjustment mechanism 32 secures inner tubular members 28*b* relative to outer tubular member 28*a*. Vertical mast 28 may be, for instance, a 20** foot extension-type D-lock, five section telescoping set sold by Testrite.

Figure 5:
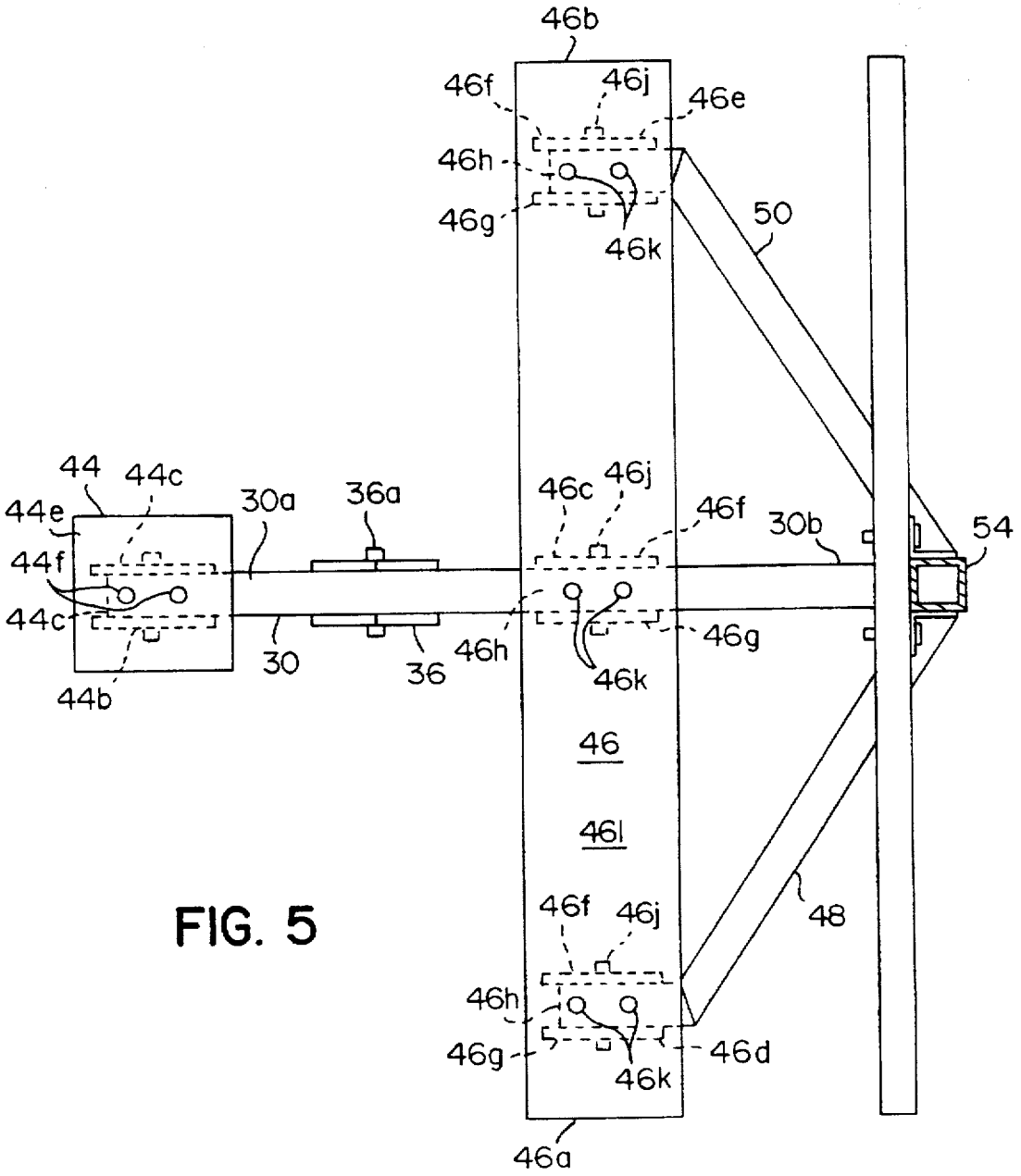
FIG. 5 is a top sectional view of the lower portion of the cable support structure taken along lines 5—5 of FIG. 3, with the mast omitted for clarity.

Horizontal truss 30, best depicted in FIG. 5, provides structural support for the various members, described herein, contacting soffit 6. A bracket 36 is mounted at the bottom surface of horizontal truss 30. A pivot pin **36*a* is disposed in bracket 36 and received in 35 a corresponding hole (not shown) provided in vertical mast 28. As best seen in FIG. 2, vertical mast 28 is pivotable relative to horizontal truss 30 at pivot pin 36*a*. In practice, vertical mast 28 pivots relative to horizontal truss 30** to accommodate varying ground slopes.

A stop assembly 38 limits the position of vertical mast 28 relative to horizontal truss 30 to within an angle α, preferably about ±10°. Stop assembly 38 preferably includes a pair of posts 40, 42, longitudinally disposed on opposite sides of bracket 36. Upon pivotal movement of vertical mast 28 relative to horizontal truss 30, one of posts 40, 42 will contact vertical mast 28, thereby preventing further pivoting motion.

Referring to FIGS. 2 and 5, a stabilizer 44 is mounted at the first end 30*a* of horizontal truss 30. A soffit load bearing member 46 is mounted midway along horizontal truss 30. As depicted in FIG. 1, both stabilizer 44 in soffit load bearing member 46 contact the soffit 6 of the building 1. Stabilizer 44 merely provides stabilization of the fall protection apparatus 10 in an unloaded condition, that is, when no worker is harnessed to the apparatus. In the loaded condition, soffit load bearing member 46 and a roof load bearing member 76 carry the load of the worker. Accordingly, as depicted in FIG. 5, soffit load bearing member 46 is elongated to provide a large area of contact with soffit 6, thus distributing the load along this large area of contact. Further stabilization of the soffit load bearing member 46 relative to horizontal truss 30 is provided by a pair of angular struts 48, 50 attached to horizontal truss 30 at a second end 30*b* thereof. Each angular strut 48, 50 is attached to one of the ends 46*a*, 46*b*, respectively, of soffit load member 46.

Again referring to FIGS. 2 and 5, stabilizer 44 includes a U-shaped bracket 44*a* including legs 44*b*, 44*c* attached to opposite sides of end 30*a* of horizontal truss 30 by means of a pivot pin 44*d*. A stabilizer plate 44*e* is attached to a base 44*c* of bracket 44*a* in a conventional manner, for instance, by a plurality of fasteners 44*f*. Similarly, soffit load bearing member 46 includes three U-shaped brackets 46*c*, 46*d*, 46*e*, each including legs 46*f*, 46*g* attached to opposite sides of horizontal truss 30 and angular struts 48, 50, respectively, by means of a pivot pin 46*j*. A bearing plate 46*l* is attached to a base 46*h* of bracket 46*c*, 46*d*, 46*e*, in a conventional manner, for instance, by a plurality of fasteners 46*k*.

Figure 3:
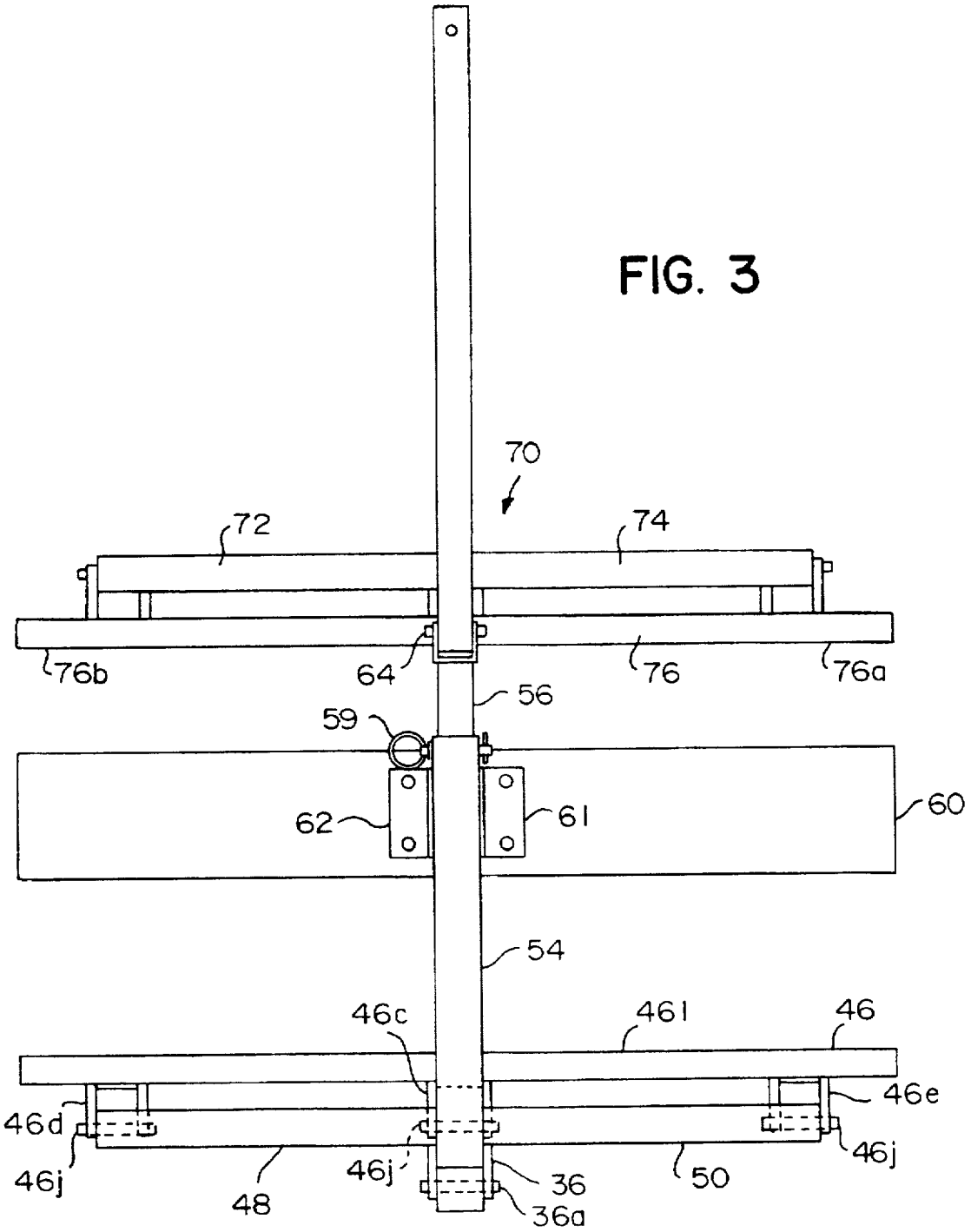
FIG. 3 is a front view of the cable support structure of the apparatus of FIGS. 1 and 2.
Figure 4:
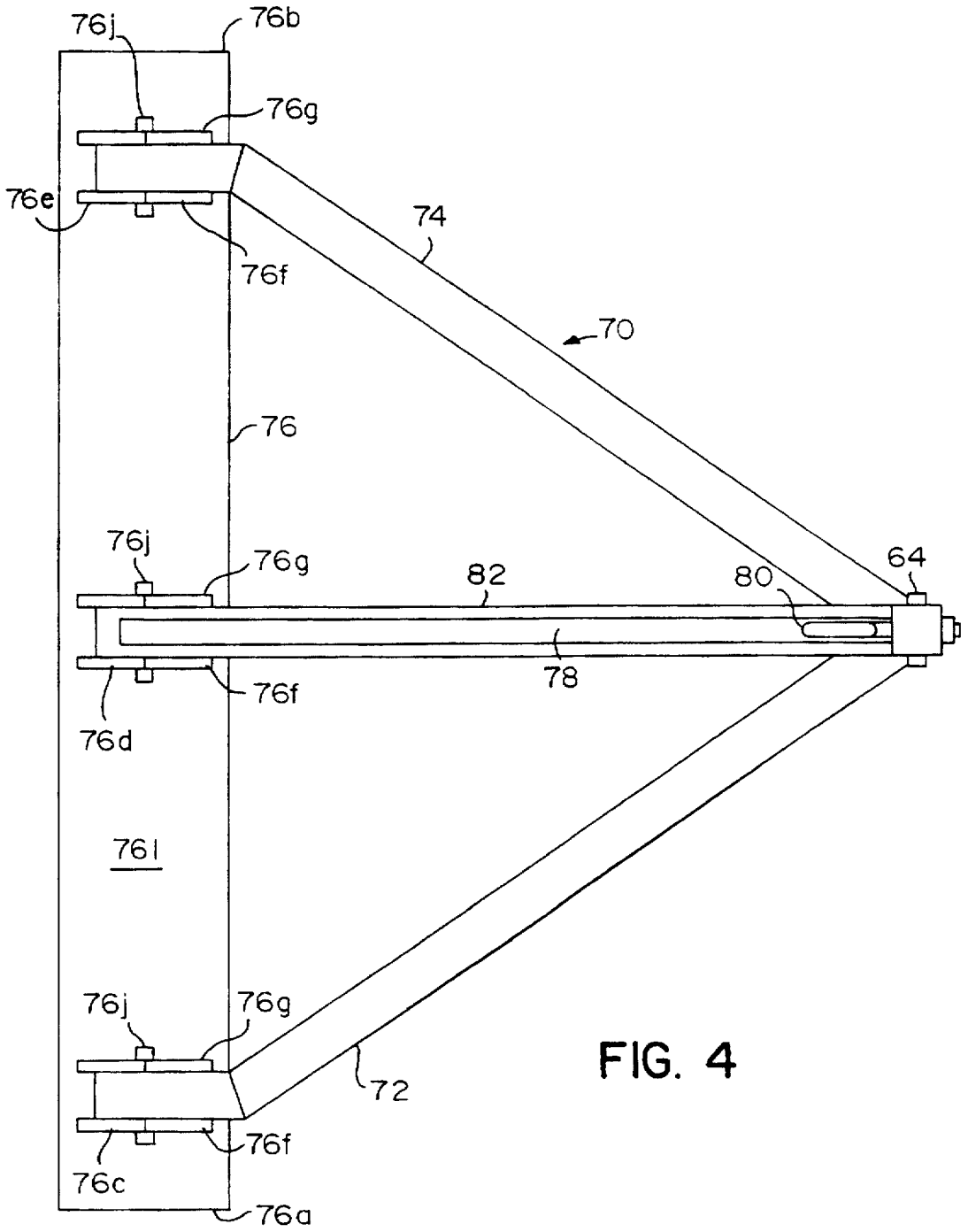
FIG. 4 is a top view of the cable support structure of FIG. 3.

Cable support structure 14 is best depicted in FIGS. 2 through 4. A vertical support 52 links cable support structure 14 with mast assembly 12. Specifically, vertical support 52 includes an outer tubular member 54, secured to horizontal truss 30 at end 30*b*. An inner tubular member 56 is received within outer nested tubular member 54. To provide height adjustment, a vertical series of holes 57 are disposed along inner nested tubular member 56. A hole 58 is provided on the outer tubular member 54. A quick release pin 59 secures outer tubular member to inner nested tubular member 56 via hole 58 and one of the series of holes 57. To provide additional stability, a horizontal stabilizer 60 is mounted to outer tubular member 54 in a conventional manner, for instance, by using angle brackets 61 and 62.

Inner nested tubular member 56 terminates in a pivot point 64. A pivot pin 66 is provided, preferably of approximately ⅜" diameter. A generally triangular brace 68 is pivotally attached to vertical support 52 at pivot point 64. A first leg 70 comprising a pair of struts 72, 74, best depicted in FIG. 4, extends from pivot point 64 to a roof load bearing member 76. Roof bearing 76 is similar in construction to soffit load bearing member 36 and contacts the upper surface of roof 2. Each strut 72, 74, extends from pivot point 64 to an end 76*a*, 76*b*, respectively, of roof bearing member 76.

A second leg 78 of generally triangular brace 68 extends from pivot point 64 to a cable attachment point 80. A third leg 82 of generally triangular brace 68 extends from cable attachment point 80 to the center portion of roof load bearing member 76.

More specifically, roof load bearing member 76 is elongated to provide a large area of contact with roof 2, thus distributing the load along this large area of contact. Roof load bearing member 76 includes three U-shaped brackets 76*c*, 76*d*, 76*e*, each including legs 76*f*, 76*g* attached to opposite sides of strut 72, third leg 82, and strut 74, respectively, by means of a pivot pin 76*j*. A bearing plate 76*l* is attached to the base of brackets 76*c*, 76*d*, 76*e*, in a conventional manner, for instance, by a plurality of fasteners.

Preferably, vertical mast 28 is made of non-conductive material, such as fiberglass. For ease of construction, the elongated members such as horizontal truss 30, angular truss 48, 50, inner and outer tubular members 54, 56, struts 72, 74, second leg 78, and third leg 82 preferably are made from a tubular steel material, such as a square tube. Cable attachment point 80 is preferably a ⅜" forged eye bolt. The material from which support foot 26 is made is not critical, and may be, for instance, plastic for cost saving reasons.

It thus can be appreciated that the apparatus of the present invention offers many advantages over the prior art systems. The apparatus, made of the materials described herein, is lightweight and portable. The telescoping vertical mast can be contracted or expanded as necessary, and in its contracted state, requires very little storage room. The apparatus contacts the roof only at the roof load bearing member 76 and at the peak of the roof. No fasteners are required. The apparatus further provides safe and effective restraint of a worker from falls.

Although a preferred embodiment of the invention has been described herein, other variations within the scope of the invention are possible. For example, the apparatus is equally applicable to other types of roofs where fall restraint is desired. The materials used to construct the apparatus may be varied according to weight, design, safety and other considerations. The triangular brace design of cable support assembly 17 may be replaced with any other suitable designs, providing an advantageous cable attachment point above the roof so as to minimize contact with the roof, as well as damage resulting from such contact. The load bearing points may be relocated, and the horizontal truss may be replaced with other suitable designs.

Although the present invention has been described and illustrated in detail, it is clearly understood the same by way of illustration in example only and is not to be taken by way of limitations, the spirit and scope of the invention being limited only by terms of the appended claims.

I claim:

1. A fall protection system for protection of a worker on a roof having a soffit, the system comprising:

a mast assembly adapted to rest on a ground surface and for contacting the soffit of the roof, and including a soffit load bearing member and a horizontal truss on which the soffit load bearing member is disposed;

a cable support structure secured to the mast assembly;

a cable connected at a first end to the cable support structure, the cable including a first portion for extending upwardly from the cable support structure toward a peak of the roof and a second portion for extending downwardly from the peak toward the ground and terminating at a second end, the second portion being adapted to connect to a harness secured to the worker; and a weight hanging from the second end of the cable to hold the cable taut.

2. A fall protection system according to claim 1, wherein the mast assembly further includes a support foot, and a generally vertical mast, and wherein the soffit load bearing member is adapted to contact the soffit.

3. A fall protection system according to claim 2, wherein the mast assembly is pivotable relative to the soffit load bearing member.

4. A fall protection system according to claim 1, wherein the mast assembly is pivotal relative to the horizontal truss.

5. A fall protection system according to claim 1, wherein the mast assembly further includes a stop for limiting the pivotal movement of the mast assembly relative to the horizontal truss.

6. A fall protection system according to claim 5, wherein the stop limits the pivotal movement of the mast assembly relative to the horizontal truss to about ±10° from horizontal.

7. A fall protection system according to claim 5, wherein the mast assembly further comprises a bracket attached to the horizontal truss and to which the mast assembly is secured, the stop comprising a pair of posts protruding from the bracket and longitudinally disposed on opposite sides of the mast assembly such that upon pivotal movement of the horizontal truss, one of the pair of posts contacts the mast assembly.

8. A fall protection system according to claim 1, wherein the mast assembly further comprises a stabilizer disposed on the horizontal truss.

9. A fall protection system according to claim 8, wherein the stabilizer is for contacting the soffit of the roof.

10. A fall protection system according to claim 8, wherein the stabilizer is for stabilizing the system in an unloaded condition.

11. A fall protection system according to claim 2, wherein the mast assembly is fiberglass.

12. A fall protection system according to claim 1, wherein the cable support structure is for disposal at an save of the roof and for extending upwardly from the eave.

13. A fall protection system according to claim 1, wherein the cable support structure includes a roof load bearing member for contacting the roof and a cable attachment point.

14. A fall protection system according to claim 13, wherein the cable support structure further includes a vertical support and a substantially triangular shaped brace pivotally secured to the vertical support at a pivot point, wherein a first leg of the triangular shaped brace is for extending from the pivot point to the roof load bearing member, a second leg of the triangular shaped brace is for extending from the pivot point to the cable attachment point, and a third leg of the triangular shaped brace is for extending from the cable attachment point to the roof load bearing member.

15. A fall protection system according to claim 14, wherein the first leg comprises a pair of struts, each for extending from the pivot point to an end of the roof load bearing member.

16. A fall protection system according to claim 15, wherein the cable support structure further includes means for adjusting the height of the vertical support.

17. A fall protection system according to claim 15, wherein the vertical support includes an outer tubular member and an inner nested tubular member and a quick release pin, the inner member including a series of vertically disposed holes, the outer member including a hole disposed at an upper end thereof, the quick release pin being received within the outer member hole and one of the series of vertically disposed holes on the inner member.

18. A fall protection system according to claim 1, wherein said weight has a mass of approximately 5 kg.

19. A fall protection system according to claim 1, further comprising a ladder for providing access to the second portion of the cable from the ground.

20. A fall protection system for protection of a harnessed worker on a roof having a soffit, the system comprising:

a mast adapted to rest on a ground surface and for contacting the soffit of the roof;

a structure including a horizontal truss;

a soffit load bearing member for contacting the soffit supported by the structure and disposed on the horizontal truss;

a roof load bearing member for contacting the roof and supported by the structure;

a cable connected to the structure for extending over a peak of the roof and downwardly toward an opposing roof soffit to a free end, the cable being adapted to connect to the worker's harness; and a weight hanging from the free end of the cable.

21. A fall protection system according to claim 20, further comprising a stabilizer supported by the structure.

22. A fall protection system according to claim 21, wherein the stabilizer is for contacting the soffit.

23. A fall protection system according to claim 21 wherein the mast includes a height adjustment mechanism for adjusting the height of the mast.

24. A fall protection system according to claim 21, wherein the structure comprises the horizontal truss on which the soffit load bearing member is disposed, a height-adjustable vertical support, and a substantially triangular shaped brace pivotally secured to the vertical support at a pivot point, the roof load bearing member being disposed on a first leg of the triangular shaped brace and the cable being connected to the triangular shaped brace at a cable attachment point.

25. A fall protection system according to claim 24, wherein the first leg is for extending from the pivot point to the roof load bearing member, the triangular brace further including a second leg for extending from the pivot point to the cable attachment point, and a third leg for extending from the cable attachment point to the roof load bearing member.

26. A fall protection system for protection of a worker on a roof having a soffit and an save, the system comprising:

a mast assembly including a support foot for resting on the ground, a vertical mast, a horizontal truss pivotally connected to the mast, a soffit load bearing member disposed on the horizontal truss and for contacting the soffit of the roof, and a stabilizer disposed on the horizontal truss and for contacting the soffit;

a cable support structure pivotally secured to the mast assembly and for disposal at the cave of the roof and extending upwardly from the eave, the cable support structure including a roof load bearing member for contacting the roof and a cable attachment point;

a cable connected at a first end to the cable attachment point, the cable including a first portion for extending upwardly from the cable support structure toward a peak of the roof and a second portion for extending downwardly from the peak toward the ground and terminating at a second end, the second portion being adapted to connect to a harness secured to the worker; and a weight hanging from the second end of the cable to hold the cable taut:

wherein the cable support structure further includes a vertical support and a substantially triangular shaped brace pivotally secured to the vertical support at a pivot point, wherein a first leg of the triangular shaped brace extends from the pivot point to the roof load bearing member, a second leg of the triangular shaped brace extends from the pivot point to the cable attachment point, and a third leg of the triangular shaped brace extends from the cable attachment point to the roof load bearing member.

27. A method of protecting a worker from falls from a building roof using a fall protection system including a mast assembly including a support foot for resting on the ground, a vertical mast, a horizontal truss pivotally connected to the mast, a soffit load bearing member disposed on the horizontal truss and for contacting a soffit of the roof, and a stabilizer disposed on the horizontal truss and for contacting the soffit, a cable support structure pivotally secured to the mast assembly and for disposal at an eave of the roof and for extending upwardly from the eave, the cable support structure including a roof load bearing member contacting the roof and a cable attachment point, a cable connected at a first end to the cable attachment point and including a first portion for extending upwardly from the cable support structure toward a peak of the roof and a second portion for extending downwardly from the peak toward the ground and terminating at a second end, the second portion being adapted to connect to a harness secured to the worker, and a weight hanging from the second end of the cable to hold the cable taut, said method comprising the steps of:

(a) erecting a vertical mast and a cable support assembly about an eave of the roof;

(b) stabilizing the vertical mast to the ground;

(c) stabilizing the cable support assembly to the soffit of the roof;

(d) positioning a cable attached to the cable support assembly over a peak of the roof and downwardly toward an opposing eave; and (e) attaching a harness worn by the worker to the cable.

28. A method according to claim 27, further comprising, before the step of attaching the harness step (d), the steps of:

(1) placing a ladder with one end on the ground and the other end in the vicinity of the cable and the opposing eave; and (2) climbing the ladder to reach the cable.

29. In a combination, a fall protection system and roof for protection of a worker on the roof having a soffit, the fall protection system comprising:

a mast assembly adapted to rest on a ground surface and adapted to contact the soffit of the roof;

a cable support structure secured to the mast assembly;

a cable connected at a first end to the cable support structure, the cable including a first portion extending upwardly from the cable support structure toward a peak of the roof and a second portion extending downwardly from the peak toward the ground and terminating at a second end, the cable adapted to connect to a harness secured to the worker.

* * * * *